United States Patent [19]

Magers et al.

[11] 4,318,498

[45] Mar. 9, 1982

[54] UPLOCKING DISPENSING PUMP

[75] Inventors: Wallace F. Magers, Leawood, Kans.; John J. Palmisano, Gladstone, Mo.

[73] Assignee: Realex Corporation, Kansas City, Mo.

[21] Appl. No.: 148,756

[22] Filed: May 12, 1980

[51] Int. Cl.[3] ..... B67D 5/32

[52] U.S. Cl. ..... 222/153; 24/211 M; 411/521; 285/340; 285/DIG. 3; 222/321

[58] Field of Search ..... 222/153, 309, 321, 384, 222/391, 402.11; 24/211 M; 411/520, 521; 285/340, DIG. 3; 169/33; 239/329, 331, 333

[56] References Cited

U.S. PATENT DOCUMENTS

| | | | |
|---|---|---|---|
| 1,734,170 | 11/1929 | Leffert | 285/DIG. 3 |
| 1,770,672 | 7/1930 | Segal | 222/384 |
| 1,849,604 | 3/1932 | Weatherhead | 411/521 |
| 2,094,423 | 9/1937 | Bernhardt | 222/384 |
| 2,321,158 | 6/1943 | Rees | 411/521 |
| 2,577,319 | 12/1951 | Feitl | 411/521 |
| 3,403,823 | 10/1968 | O'Donnell | 222/153 |

FOREIGN PATENT DOCUMENTS

| | | | |
|---|---|---|---|
| 2300019 | 9/1976 | France | 222/153 |

*Primary Examiner*—H. Grant Skaggs
*Attorney, Agent, or Firm*—Schmidt, Johnson, Hovey & Williams

[57] ABSTRACT

The plunger may be releasably locked in a fully extended condition against depression by an annular locking disc which receives the plunger and has a series of radially inwardly projecting, circumferentially spaced, plunger-engaging teeth snapped into a notch on the plunger. The teeth are slightly outwardly inclined in the direction of plunger extension, and stationary structure on the pump adjacent the plunger cooperates with the teeth to prevent them from being reversely flexed when depression of the plunger is attempted, thereby securely locking the same in its upwardly extended position. By gripping a tab on the disc and flexing it upwardly so as to reversely flex at least certain of the teeth, attempted depression of the plunger while the teeth are in that condition will release the plunger so that full depression may continue. The disc becomes stored on the plunger on the first lock-releasing stroke and remains snugly against the underside of the dispensing head unless the disc is once again intentionally slid downwardly from its unlocked position along the plunger into locking engagement with the notch.

9 Claims, 6 Drawing Figures

UPLOCKING DISPENSING PUMP

TECHNICAL FIELD

This invention relates to hand-operated dispensing pumps, and, more particularly, to improvements in locking the plungers of such pumps in an "up" or fully extended position for shipment or storage purposes.

BACKGROUND ART

Locking clips and the like for "uplocking" dispensing pumps are not new per se. For example, prior such devices are disclosed in Carlson et al U.S. Pat. No. 2,686,652; Bernhardt U.S. Pat. No. 2,094,423; and Segal U.S. Pat. No. 1,770,672. A stroke limiter is illustrated in Vignot U.S. Pat. No. 4,120,429. See also Magers U.S. Pat. No. 3,590,691, assigned to the assignee of the present invention.

SUMMARY OF THE INVENTION

An alternative to the locks previously available is presented by the present invention. Herein an annular disc having a series of circumferentially spaced, radially inwardly projecting spring teeth or pawls on its inner periphery receives the plunger and is stored snugly up against the underside of the dispensing head of the pump. The diameter of the central hole in the disc is slightly less than the diameter of the plunger, and thus when locking of the plunger is desired, the disc is slid down along the plunger until the spring teeth snap into a notch and the disc comes to rest against stationary structure adjacent the plunger. Because the teeth are slightly outwardly inclined in the direction of extension of the plunger, and due to the fact that the disc is held by the stationary structure, the teeth remain firmly snapped into the notch even when depression of the plunger is attempted, in spite of the fact that the disc is constructed of a synthetic resinous material exhibiting properties of flexibility and memory. Preferably, a rim on the stationary collar bears against the periphery of the disc in the locked mode and causes the teeth to be pre-loaded with spring pressure that biases the plunger outwardly. This prevents any minute pumping strokes that might tend to occur during handling and shipment, thereby avoiding accidental priming of the pump and inadvertent discharge. When unlocking is desired, a gripping tab associated with the disc is utilized to flex the disc in a way that reversely flexes at least certain of the teeth into an oppositely inclined condition, permitting them to bend out of the notch when the plunger is then simultaneously depressed. Having released the plunger, the disc then becomes stored up against the underside of the dispensing head.

DETAILED DESCRIPTION

Figure 1:
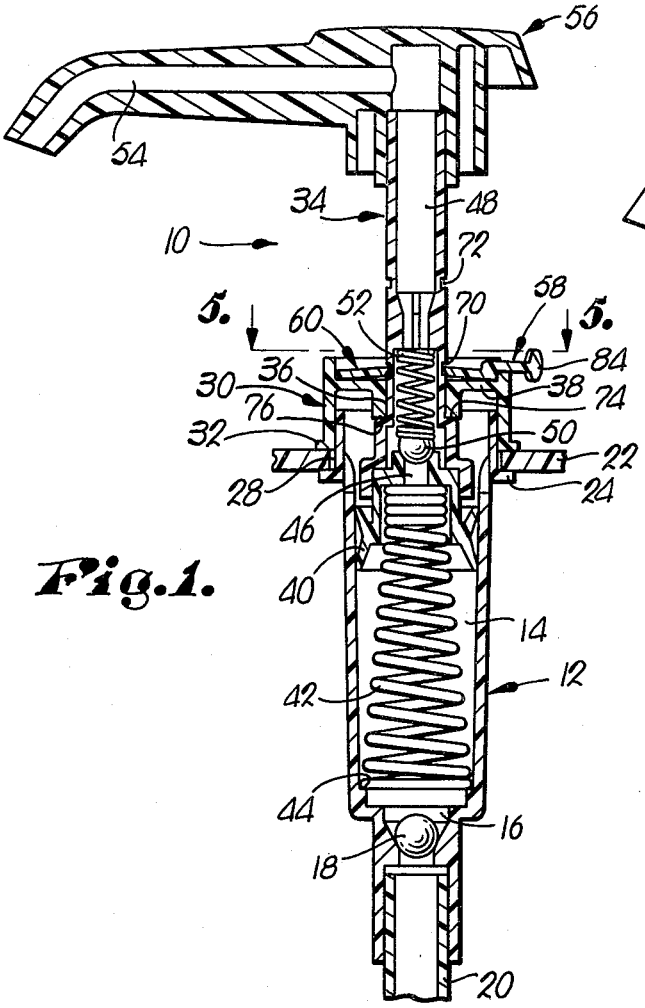
FIG. 1 is a fragmentary vertical cross sectional view of a dispensing pump utilizing a locking arrangement in accordance with the principles of the present invention.

The pump 10 has a hollow, open-ended body 12 defining an internal chamber 14 having an inlet 16 at its lower end that is controlled by a ball valve 18. A fragmentarily shown dip tube 20 projects downwardly from the body 12 for insertion into a body of liquid to be dispensed, such liquid being contained within a suitable receptacle (not shown) having a closure 22 to which the pump 10 may be attached. In this regard, the body 12 has a radially outwardly projecting lip 24 underlying the closure 22 with the upper end 26 of the body 12 projecting upwardly from the radially inner extremities of the lip 24 through an opening 28 in the closure 22. A collar 30 secured to the upper end 26 as by threading engagement or bonding has a radially outwardly projecting lowermost flange 32 bearing against the top side of the closure 22 in opposition to the lip 24 such that the lip 24 and the flange 32 cooperate to firmly clamp the closure 22 therebetween, thereby securely attaching the pump 10 to the receptacle.

A plunger 34 reciprocates through a bore 36 in a top wall 38 of the collar 30 and has a piston 40 affixed to its lower end for reciprocation within the chamber 14 in wiping engagement with the internal surface of the body 12. A coil spring 42 resting on a ledge 44 adjacent the inlet 16 engages the piston 40 at the other extreme so as to yieldably bias the plunger 34 toward its fully extended position of FIG. 1. An orifice 46 in the piston 40 communicates the chamber 14 with an internal passage 48 of the plunger 34 as controlled by a normally closed ball valve 50 under the influence of control spring 52. The passage 48 communicates at its upper end with a discharge outlet 54 in an actuating head 56 for the plunger 34.

In accordance with the present invention, the plunger 34 may be selectively locked in its fully extended position through the use of locking disc 58. As noted, the disc 58 comprises an annular member 60 constructed of a material which renders it tough, resistant to breakage, flexible, and having sufficient "memory" to return to its original configuration if flexed. Preferably, the entire disc 58 may be molded out of a suitable acetal resin, but other materials that exhibit similar characteristics may be used.

In its broadest respects the locking disc 58 need not take the configuration of a complete annulus; indeed, it is within the scope of the broadest aspects of the present invention to have the locking disc 58 "C" shaped or otherwise shaped in a less than continuous, 360° annulus, depending upon the intended final use of the locking disc 58. For example, if the disc 58 is intended to be disposable and used only to fulfill one locking function as during shipment of the product to then be discarded upon first use of the pump 10, the disc 58, while still desirably flexible with a degree of inherent memory, need not be as tough and reusable as when it is intended for repetitious locking and unlocking. Thus, in those situations, the disc 58 may be constructed of a material which is frangible or fracturable by the deliberate action of the user; and since there is no desire in that event to store the locking disc 58 on the pump 10 during periods of nonuse, there is less need for the member 60 to be a complete 360° circle.

In any event, the particular embodiment chosen for purposes of illustration shows the member 60 provided with a central hole 62 which is defined by a plurality of radially inwardly projecting, circumferentially spaced pawl teeth 64, adjacent teeth 64 in the series being separated by slits 66 so as to render the teeth 64 independently flexible in addition to their inherent flexibility and resiliency provided by the nature of the material from which the disc 58 is constructed. The radially outermost ends of the slits 66 terminate in circular perforations 68.

Figure 4:
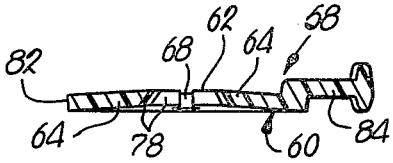
FIG. 4 is a transverse cross sectional view thereof taken substantially along line 4—4 of FIG. 3.

As illustrated in FIGS. 1 and 4, the member 60 is slightly saucer-shaped so that the teeth 64 have a natural rake out of the otherwise flat plane of the member 60. The hole 62 is slightly smaller in diameter than the plunger 34 such that, when the disc 58 is on the plunger 34, the teeth 64 must yield in a direction away from the plunger 34 to permit acceptance of the latter within the hole 62. The disc 58 is installed in such a way that the raked side of the disc 58 faces the actuating head 56, and thus the teeth 64 normally assume a slightly outwardly inclined attitude or condition in the direction of extension of the plunger 34. When not in a locked condition the disc 58 may be forcibly and manually slid along the plunger 34, such intentional movement being permitted by the yieldable nature of the teeth 64.

The plunger 34 is provided with one or more notches 70 and 72 which completely circumscribe the plunger 34 and are axially spaced along the latter at positions determined by the desired stroke length of the plunger 34 and the need to locate a notch 70 or 72 adjacent the floor 38 when the plunger 34 is fully extended to the extent permitted by its designed-in stroke length. In this regard, it will be noted that an upwardly facing ledge 74 on the plunger 34 abuts a downwardly facing stop 76 depending from the floor 38 when the plunger 34 is fully extended, the degree of such extension, and thus the stroke length and capacity of the pump 10 during each pumping stroke, depending upon the particular length of the depending stop 76. In the illustrated embodiment, the stop 76 extends down into the chamber 14 a distance that causes the notch 70 to be positioned only slightly above the floor 38 at full extension of the plunger 34. In another embodiment, however, the length of stop 76 might be such as to permit the plunger 34 only to extend far enough to locate the notch 72 slightly above the floor 38, the notch 70 in that event being located further inwardly of the pump body 12.

Figure 6:
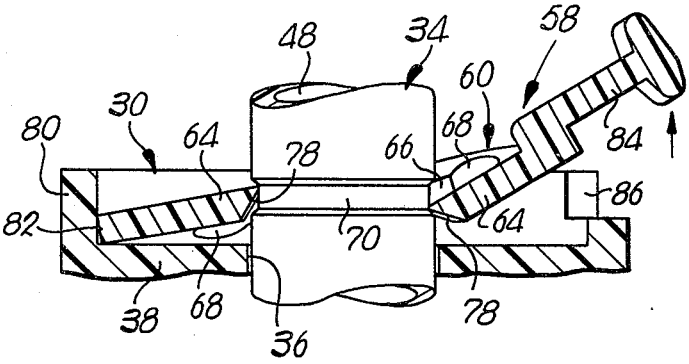
FIG. 6 is an enlarged, fragmentary cross sectional view corresponding essentially to the condition of the components in FIG. 2 and illustrating the manner in which the locking disc is released.
Figure 5:
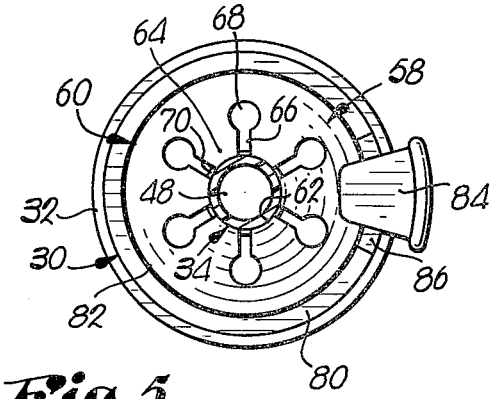
FIG. 5 is an enlarged transverse cross sectional view through the pump taken substantially along line 5—5 of FIG. 1.

The teeth 64 are provided with innermost beveled tips 78 as perhaps shown most clearly in FIGS. 4 and 6. Notches 70, 72 are of such width as to accept the tips 78 when the teeth 64 are aligned therewith, it being remembered that the spring-biased nature of the teeth 64 causes the latter to snap into a notch 70 or 72 under such circumstances. The bevel of each tooth tip 78 is such that the sharpest edge of each tip 78 is on the side facing the actuating head 56 so as to securely snag the teeth 64 into a notch 70 or 72 when locking is desired.

The floor 38 represents stationary structure adjacent the plunger 34 during reciprocation of the latter. As will be noted below, the floor 38 cooperates with the member 60 in maintaining the plunger 34 locked against depression. If desired, and in the preferred form of the invention, additional cooperating structure in the nature of an annular rim 80 rising upwardly from the floor 38 at its radially outermost extent may be provided to function as shoulder means in circumscribing relationship to the outermost periphery 82 of the member 60 when the disc 58 is in a locked condition. As explained below, rim 80 serves to prevent radial expansion of the member 60 when depression of the plunger 34 is attempted.

If desired, the disc 58 may further include an operating tab 84 fixed to the member 60 as an integral, molded part thereof and projecting radially outwardly therefrom to facilitate user manipulation. A recess 86 may be provided in the rim 80 to afford clearance for the tab 84 in the locked mode of the pump 10.

OPERATION

As above noted, the locking disc 58, in its preferred embodiment, is carried by the plunger 34 during operation of the latter. Typically, the disc 58 in such circumstances is located in a stored position indicated by dotted lines in FIG. 2 directly up against the underside of the actuating head 56. In this position the disc 58 in no way impedes or otherwise affects full and complete actuation of the plunger 34. As is well understood by those skilled in the art, depression of the actuating head 56 causes the piston 40 to be shifted downwardly within the chamber 42 toward the inlet 16. Any liquid within the chamber 14 below the piston 40 thus seats the ball valve 18 to close off the inlet 16 and unseats the upper ball valve 50 to communicate the chamber 14 with the passage 48. Thus, the liquid is forced up through the passage 48 and out the outlet 54 during the depression stroke. On the other hand, during the up stroke or extension stroke of the plunger 34 caused by the return spring 42, the upwardly moving piston 40 induces a suction action within the lower part of the chamber 14, unseating the lower ball valve 18 to draw in a new supply of liquid but reseating the upper ball valve 50 with the help of the spring 52. The pump is thus ready for the next discharging stroke.

If it is desired to lock the pump 10 with the plunger 34 fully extended, it is only necessary for the user to slide the locking disc 58 down the plunger 34 until the teeth 34 snap into the notch 70 (assuming that the length of stroke of the plunger 34 is as illustrated by the preferred embodiment herein which places the notch 70 rather than the notch 72 more closely adjacent the floor 38 when the plunger 34 is fully extended).

When the teeth 64 snap into the notch 70 they remain slightly outwardly inclined in the direction of an extension stroke as may be seen viewing FIG. 1. In this attitude the teeth 64 function as one way pawls which would permit further outward extension of the plunger 34 if such were available but which stiffly oppose any depression of the plunger 34 because that would necessitate pivoting the pawl teeth 64 into a reversely flexed and inclined condition. Any attempt at depression of the plunger 34 simply flexes the teeth 64 in tighter against the plunger 34 instead of away from the latter, thereby simply further reducing the already small diameter of the hole 62 relative to the plunger 34. In other words, once the teeth 64 have snapped into the notch 70, the hole 62 must first get smaller before it gets bigger if the plunger 34 is to pass on down through the disc 58, and this naturally firmly interlocks the disc 58 and the plunger 34 against relative movement in that direction.

Since the disc 58 is under abuted by the floor 38 and is prevented from downward movement, the plunger 34 is likewise prevented from downward movement. And the rim 80 which serves as a shoulder against the outer periphery 82 of the member 60 at this time prevents outward expansion of the member 60 caused by any attempted depression of the actuating head 56, thereby making it increasingly difficult for the teeth 64 to flex over center into a reversely inclined condition.

Preferably, the internal diameter of the rim 80 and the external diameter of the member 60 are such that rim 80 slightly pre-loads the member 60 in an outwardly (upwardly) biased condition when member 60 fits down within the rim 80 and the fingers 64 snap into the notch 70. The spring-like pre-loading helps resist any minute pumping displacement of the plunger 34 that might otherwise occur during shipment and handling. Consequently, priming of the pump and inadvertent discharge is avoided. It should also be noted that the pre-loading of member 60 helps seat the ledge 74 of plunger 34 tightly against the stop 76 on floor 38 to assist return spring 42 in providing a liquid seal at that point when plunger 34 is in its extended position.

Figure 2:
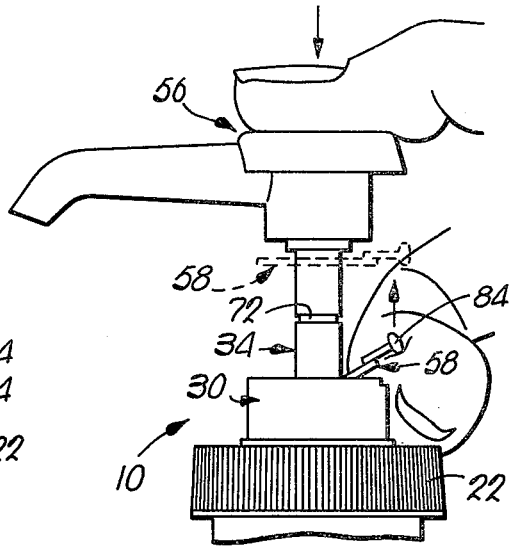
FIG. 2 is a fragmentary elevational view of the pump illustrating the way in which the locking disc is released and subsequently stored on the plunger.
Figure 3:
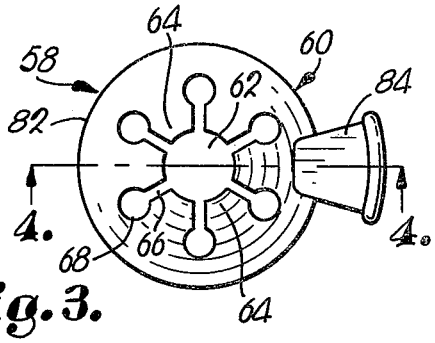
FIG. 3 is a top plan view of the locking disc.

Intentional unlocking of the plunger 34 is a simple matter. As illustrated in FIG. 2 and as shown in an enlarged illustration in FIG. 6, by simultaneously lifting the tab 84 and depressing the actuating head 56, at least certain of the teeth 64 may be flexed or reversely pivoted into an oppositely inclined condition generally in the direction of depression so that, upon continued attempt at depression of the plunger 34, the reversely flexed fingers 64 will yield away from the plunger 34 and release the notch 70. The plunger 34 is thereupon free to be fully depressed to the extent permitted by the underside of the head 56. As such initial unlocking depression takes place, all of the fingers 64 slip up out of the notch 70 and return to their natural slightly outwardly inclined condition. Furthermore, engagement of the member 60 with the floor 38 when the teeth 64 are above the notch 70 will cause the disc 58 to slide up along the plunger 34 to its stored position immediately beneath the actuating head 56.

As mentioned earlier herein, at least in its broadest respects the present invention is not limited to a permanent, reusable lock for the pump 10. It may be desired to lock the plunger 34 only once in the life of the pump 10, i.e., for initial shipment and subsequent display at the point of sale of the product. Under those circumstances, the lock 58 may be sufficiently inherently flexibly as to permit the aforementioned flexing of the teeth 64 yet may be of such design as to be subject to intentional fracture by the user at the time of initial unlocking. The fractured lock may then simply be discarded.

On the other hand, the lock might be so designed that it could be pulled off the plunger 34 or otherwise removed for unlocking. In all cases, however, the principle of the one way pawl tooth action would be retained which requires that the pawl teeth be reversely flexed into an oppositely inclined condition in order to release the plunger 34 for depression.

As compared to prior locks, it will be noted that the present invention may be readily molded as an integral, unitary component so that it may be mass-produced at a relatively nominal cost. It does not require substantial configuration variations in the plunger 34 as required by some prior locks, it does not require a multitude of different components to achieve its desired function, and it is relatively simple to use. Hence, it should be apparent that the present invention represents a significant advance in the art.

We claim:

1. In combination with a hand-operated dispensing pump having a depressible plunger and normally stationary structure adjacent the plunger, a releasable lock for preventing depression of the plunger comprising:

a generally flat, unitary member disposed generally transversely of said plunger and receiving the latter in at least partial circumscribing relationship therewith, said member having a plunger-engaging portion normally inclined slightly outwardly in the direction of extension of the plunger but being flexible into a reversely inclined condition in the direction of depression of the plunger, said member being cooperable with said structure when in engagement therewith and said portion is in its normally outwardly inclined condition to oppose depression of the plunger and being operable when said portion is manually flexed to its reversely inclined condition to permit depression of the plunger, said plunger being provided with a notch for lockingly receiving said portion of the member when the latter is in said normally outwardly inclined condition.

2. In the combination as claimed in claim 1, wherein said member is carried by the plunger out of said notch during normal operation of the plunger and is manually shiftable along the same and into the notch for locking.

3. In combination with a hand-operated dispensing pump having a depressible plunger and normally stationary structure adjacent the plunger, a releasable lock for preventing depression of the plunger comprising:

a generally flat, unitary member disposed generally transversely of said plunger and receiving the latter in at least partial circumscribing relationship therewith, said member having a plunger-engaging portion normally inclined slightly outwardly in the direction of extension of the plunger but being flexible into a reversely inclined condition in the direction of depression of the plunger, said member being cooperable with said structure when in engagement therewith and said portion is in its normally outwardly inclined condition to oppose depression of the plunger and being operable when said portion is manually flexed to its reversely inclined condition to permit depression of the plunger; and a manually operable pull tab fixed to said member and projecting outwardly therefrom to facilitate said manual flexing of said portion to its reversely inclined condition.

4. In combination with a hand-operated dispensing pump having a depressible plunger and normally stationary structure adjacent the plunger, a releasable lock for preventing depression of the plunger comprising:

a generally flat, unitary member disposed generally transversely of said plunger and receiving the latter in at least partial circumscribing relationship therewith, said member having a plunger-engaging portion normally inclined slightly outwardly in the direction of extension of the plunger but being flexible into a reversely inclined condition in the direction of depression of the plunger, said member being cooperable with said structure when in engagement therewith and said portion is in its normally outwardly inclined condition to oppose depression of the plunger and being operable when said portion is manually flexed to its reversely inclined condition to permit depression of the plunger, said structure including abutment means underlying said portion of the member with respect to the direction of depression of the plunger, said structure further including shoulder means spaced radially outwardly from said plunger in disposition for abutting engagement with said member to prevent radially outward yielding movement of the member during attempted depression of the plunger when the latter is locked by the member.

5. In combination with a hand-operated dispensing pump having a depressable notched plunger and normally stationary structure adjacent the plunger, a releasable lock for preventing depression of the plunger comprising:

a generally flat, annular member having a central hole which receives said plunger, said member being provided with a plurality of radially inwardly projecting, plunger-engaging pawl teeth distributed circumferentially about and defining said hole, said hole being normally slightly smaller in diameter than said plunger but said teeth being yieldably flexible in a direction away from the plunger to forcibly accept the latter, said member normally being carried by the plunger during actuation thereof but being manually slidable along the same to a position engaging said teeth in said notch, at which time the teeth are slightly outwardly inclined in the direction of extension of the plunger and the member is in cooperating engagement with said structure to oppose depression of the plunger, at least certain of said teeth being intentionally temporarily reversely flexible by selectively applied manual force into an oppositely inclined condition while depression of the plunger is attempted, thereby releasing the teeth from the notch to unlock the plunger upon further depression and causing the member to become stored on the plunger with the teeth out of the notch and returned to said outwardly inclined condition.

6. In the combination as claimed in claim 5; and an operating tab fixed to said member and projecting outwardly therefrom to facilitate manual reverse flexure of said teeth to release the lock.

7. In the combination as claimed in claim 5, wherein said structure includes abutment means underlying said teeth with respect to the direction of depression of the plunger.

8. In the combination as claimed in claim 7, wherein said structure further includes shoulder means spaced radially outwardly from said plunger in disposition for abutting engagement with said member to prevent radially outward yielding movement of the member during attempted depression of the plunger when the latter is locked by the member.

9. In the combination as claimed in claim 5, wherein the pump further includes means limiting the extension stroke of the plunger; and a second notch in the plunger spaced axially from the first-mentioned notch for use with said member in locking the plunger when the stroke limiting means is adapted to position said second notch for locking rather than to position said first-mentioned notch for locking.

* * * * *